US005685478A

United States Patent [19]

Tang

[11] Patent Number: 5,685,478

[45] Date of Patent: Nov. 11, 1997

[54] SINGLE PIECE CONTAINER AND METHOD FOR MAKING

[76] Inventor: Donald Tang, 11120 Candlelight La., Potomac, Md. 20854

[21] Appl. No.: 617,998

[22] Filed: Mar. 18, 1996

[51] Int. Cl.[6] ..... B65D 5/462

[52] U.S. Cl. ..... 229/117.14; 229/148; 229/911; 493/88; 493/909

[58] Field of Search ..... 229/117.14, 148, 229/910, 911, 912; 206/520; 493/88, 295, 909

[56] References Cited

U.S. PATENT DOCUMENTS

| | | | |
|---|---|---|---|
| 1,009,804 | 11/1911 | Sugarman | 229/117.14 |
| 2,355,729 | 8/1944 | Inman | 229/911 |
| 3,198,378 | 8/1965 | Farquhar | 229/117.14 |
| 5,228,617 | 7/1993 | McGrath | 229/148 |
| 5,358,175 | 10/1994 | Cai | 229/117.14 |
| 5,489,063 | 2/1996 | Buchalski et al. | 206/520 |

FOREIGN PATENT DOCUMENTS

| | | | |
|---|---|---|---|
| 389254 | 9/1990 | European Pat. Off. | 229/117.14 |

*Primary Examiner*—Gary E. Elkins

*Attorney, Agent, or Firm*—Wolf, Greenfield & Sacks, P.C.; Paul D. Sorkin, Esq.

[57] ABSTRACT

A single piece container and method for making the same are presented. The container has an opening and a body and includes first and second pairs of opposing covering flaps and a pair of opposing handles. The covering flaps cover the container body opening so as to keep the container contents in place.

23 Claims, 4 Drawing Sheets

SINGLE PIECE CONTAINER AND METHOD FOR MAKING

BACKGROUND OF THE INVENTION

1. Field of the Invention

This invention relates to a single piece container and to a method of making the same.

2. Discussion of the Related Art

It is often necessary to provide an inexpensive container to hold various items. One familiar situation is for left-over food in a restaurant. Another situation is take-out food, such as Chinese food, which is typically provided in inexpensive paper containers.

A familiar container 1 for leftovers is shown in FIG. 1. This container is usually made of stiff paper folded into a rectangular configuration to hold food. Flaps 5 are provided to cover an opening and keep the contents in place. A tab or slot is provided to keep the flaps 5 in place. For ease in carrying the leftover container 1, a metal handle 3 is provided. The metal handle 3 also provides structural integrity. As mentioned above, the leftover container 1 is usually made of stiff paper, and this paper is typically coated to resist moisture degradation.

The leftover container 1 is constructed by folding a paper sheet into shape. External to the container are at least two folds 9 which serve to hold together the sides of the container. The metal handle 3 fits into a pair of pivot/connecting holes 7, and maintains the folds 9 in position. Once each end of the metal handle 3 is in a respective pivot/connecting hole 7, the leftover container 1 is complete and ready to receive food.

The leftover container 1 of FIG. 1 has certain drawbacks. While the paper material can be prepared by a machine, the container must still be folded into shape. This adds to the cost of manufacturing the container. Furthermore, since the container is a product of folding, the folds represent additional material which does not actually hold the contents, i.e., the folds are needed to maintain the structure of the container and do not serve to enlarge the container. Thus, the folds require additional material without increasing the size.

The use of the metal handle 3 has shortcomings of its own. Since the paper material is usually stiff, it is difficult to place the metal handle 3 into the pivot/connecting hole 7, making the folding operation difficult. Since the metal handle 3 is used to keep the leftover container 1 together, the metal handle must be of a significant thickness and strength. In addition, the metal handle must be moved out of the way in order to place contents in the container as well as remove those contents from the container. Also important, since the handle is metal, the container cannot be placed in a microwave oven to re-heat the contents due to the possibility of sparking. Further, the folds do not provide a watertight container. While the material may be coated with plastic, moisture can still find a way out via the folds. Also, the paper of this leftover container container cannot be recycled easily. Finally, this container cannot be easily reused by a user since it cannot be adequately cleaned.

In summary, the design of the classic leftover container 1 suffers from a number of disadvantages including using more material than is necessary for optimum container size, a design which is not recyclable, that cannot be placed directly in the microwave and that cannot be washed in a dishwasher.

SUMMARY OF THE INVENTION

A single piece container according to the present invention includes an integral formed container body made from a single piece of material. The body has a bottom and a side wall and first and second pairs of opposing edges which define a container body opening. A first pair of opposing covering flaps are provided, with each flap hingeably disposed at a respective opposing edge of the first pair of opposing edges. A second pair of opposing covering flaps are provided with each flap hingeably disposed at a respective opposing edge in the second pair of opposing edges. A pair of opposing handles are also hingeably disposed at a respective opposing edge of the second pair of opposing edges.

A method of making a container from a single piece of material includes forming in the single piece of material a container body including a bottom, a first pair of opposing edges and a second pair of opposing edges, the first and second pairs of opposing edges defining a container body opening. A first pair of opposing covering flaps are formed, each flap hingeably disposed at a respective opposing edge in the first pair of opposing edges. In addition, the method includes forming a second pair of opposing covering flaps, each flap hingeably disposed at a respective opposing edge in the second pair of opposing edges and forming a pair of opposing handles, each handle hingeably disposed at a respective opposing edge in the second pair of opposing edges.

BRIEF DESCRIPTION OF THE DRAWINGS

Other features and advantages of the single piece container according to the present invention will become apparent from the following detailed description of embodiments thereof, given by way of non-limiting examples with reference to the accompanying drawings.

In the drawings.

DETAILED DESCRIPTION

Figure 1:
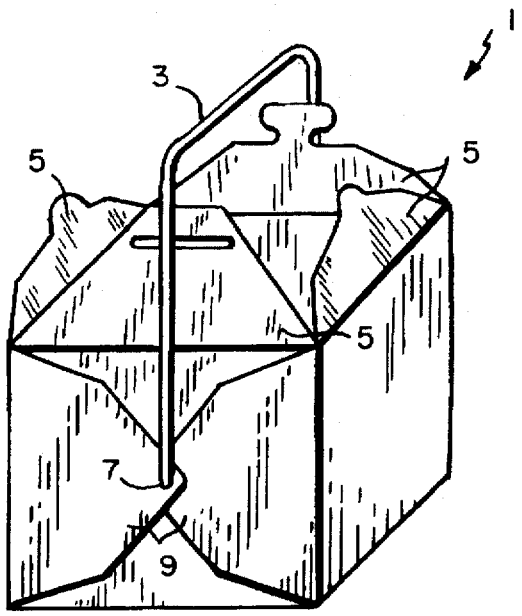
FIG. 1 PRIOR ART
FIG. 1 is a perspective view of a leftover container as known in the related art.
Figure 2:
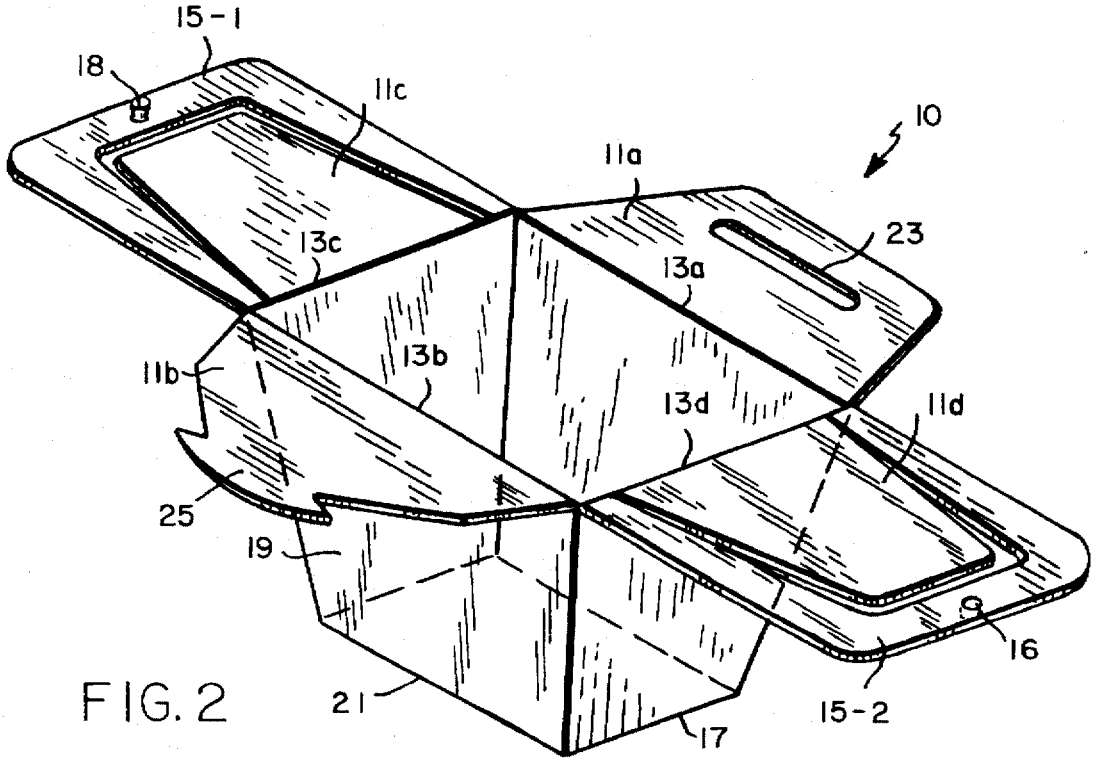
FIG. 2 is a perspective view of a first embodiment of a single piece container of the present invention.

With reference to the drawing views, generally and schematically shown is a single piece container 10 embodying this invention. As shown in FIG. 2, the single piece container 10 has a container body 17 which in the present embodiment is of a substantially rectangular shape and includes a sidewall 19. The container body 17 also has a bottom 21. The container body 17 has an opening defined by two pairs of opposing edges 13*a*, 13*b* and 13*c*, 13*d*. Integrally formed, i.e., from the same piece of material, with the container body 17 are two pairs of opposing covering flaps 11*a*, 11*b* and 11*c*, 11*d*. The first pair of covering flaps 11*a*, 11*b* are hingeably connected to the container body 17 at opposing edges 13*a*, 13*b*, respectively. As shown in FIG. 2, the other set of opposing covering flaps 11*c*, 11*d* are hingeably connected to the container body 17 at edges 13*c* and 13*d*, respectively. In addition, a pair of opposing handles 15-1, 15-2 are also hingeably connected to the container body 17 at opposing edges 13*c* and 13*d*, respectively. In other words, as shown in FIG. 2, handle 15-1 and covering flap 11*c* are hingeably connected at edge 13*c* while handle 15-2 and covering flap 11*d* are hingeably connected at edge 13*d*.

It should be noted here that the container body 10, the handles 15-1, 15-2 and covering flaps 11*a*–11*d* are of a single piece of material and the flaps being hingeably connected does not indicate that there is a separation of the flaps from the container, hingeably connected refers to the movement of which the covering flaps are capable. The edges 13*a*–13*d* represent the points about which the covering flaps 11*a*–11*d* rotate.

As discussed below, in order to maintain the contents within the container body, the two pairs of opposing covering flaps 11*a*–11*d* are folded at each respective edge to cover the container body opening. In order to keep the flaps in place, a slot 23 is provided in covering flap 11*a* and a bifurcated tab 25 is provided on covering flap 11*b*. When in the closed position, the tab 25 will fit into the slot 23 thereby keeping the container closed. In operation, flaps 11*c*, 11*d* would be folded over first followed by flap 11*a* with covering flap 11*b* folded over last so that the tab 25 fits into the slot 23.

Figure 3:
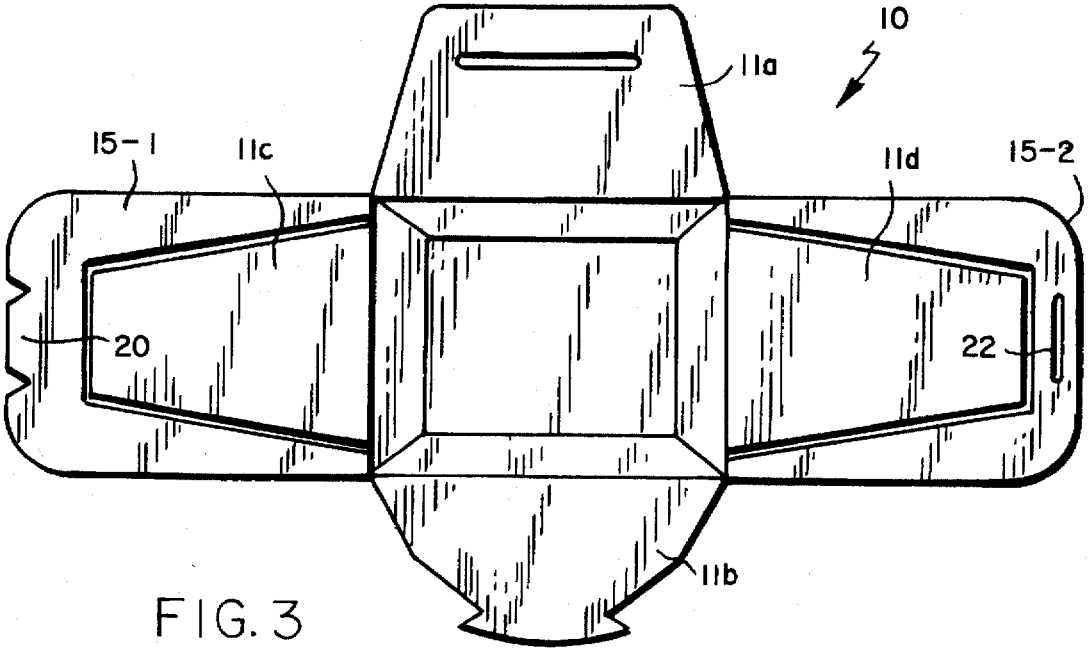
FIG. 3 is a top view of the first embodiment of the present invention.

As shown in FIG. 3, from above, the single piece container 10 provides for a clear path for placing items into the container body 17. When the covering flaps 11*a*–11*d* and the handles 15-1, 15-2 are not in a closed position, they do not interfere with either the placing or removing items in or from the container body 17. The covering flaps 11*a*–11*d* along with the handles 15-1, 15-2 can be placed in a position so as to guide any loose product into the container body 17 and therefore together act as a funnel.

Figure 4:
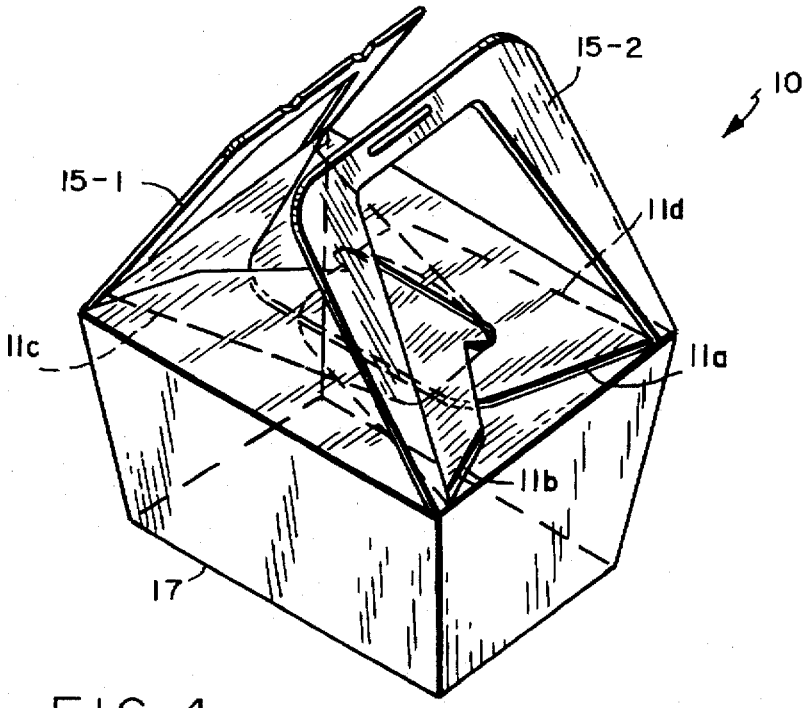
FIG. 4 is a perspective view of the first embodiment of the present invention in a closed position.
Figure 5:
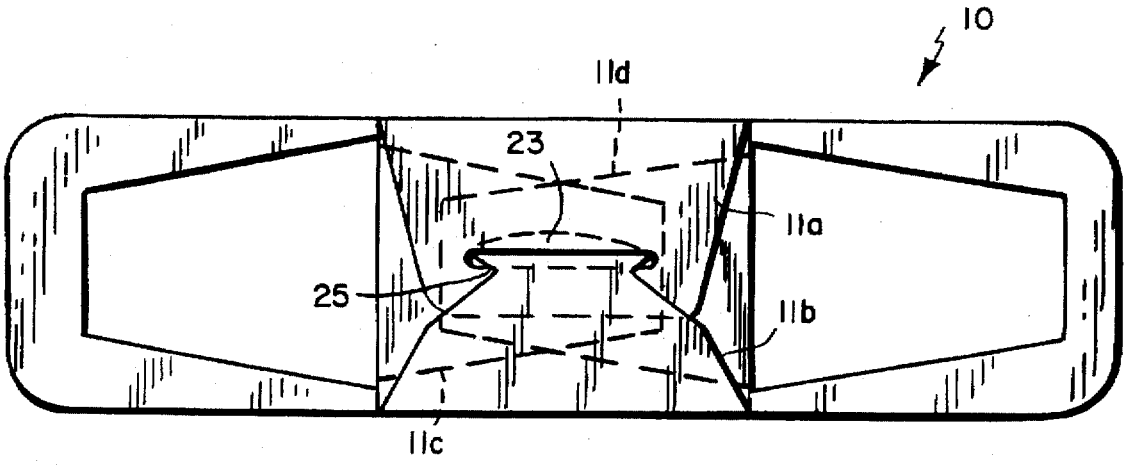
FIG. 5 is a top view of the first embodiment of the present invention in the closed position as shown in FIG. 4.

As shown in FIG. 4, the single piece container 10 with the covering flaps 11*a*–11*d* in the closed position will keep substantially all the product within the container body 17. The handles 15-1, 15-2 can then be used to carry the single piece container 10. As shown in FIG. 5, the interlocking of the tab 25 and the slot 23 when flaps 11*a* and 11*b* are positioned above flaps 11*c* and 11*d* will keep the container closed.

Further, referring to FIG. 2, a male locking snap 16 is provided in handle 15-2. Corresponding to the male locking snap 16 is a female locking receiver 18 disposed in handle 15-1. After the covering flaps 11*a*–11*d* are in the closed position, the handles are brought into contact with one another so that the female locking receiver 18 will receive the male locking snap 16 thus holding the handles together and in place. As a result, the container can then be picked up with one hand by a user without having to bring the handles together since they will naturally want to remain disconnected from one another.

An alternative mechanism for keeping the handles together is shown in FIG. 3. A handle tab 20 is provided in handle 15-1 and a handle slot 22 is provided in handle 15-2. When the handles are brought into contact with one another, the handles tab 20 will slide into the handle slot 22 thereby keeping the handles connected to one another.

The single piece container 10 is made from a single piece of material, usually plastic, by either a thermal forming or injection molding process. The plastic used will depend on the characteristics desired such as, e.g., durability, weight, color, etc. The single piece of plastic is placed on a die and heated to a temperature which makes the plastic malleable. Using a combination of vacuum and the shape of the die itself, the container body 17 is first formed in the plastic material. After this step, the opening of the container body 17 has been defined. The excess material is cut away leaving only the covering flaps 11*a*, 11*b* and an outer periphery of the handles 15-1 and 15-2. The second pair of covering flaps 11*c*, 11*d* are cut from the area within the periphery of the handles 15-1 and 15-2. At this point, the slot 23 is cut in the covering flap 11*a* and the covering flap 11*b* is cut so as to include the tab 25.

Figure 6:
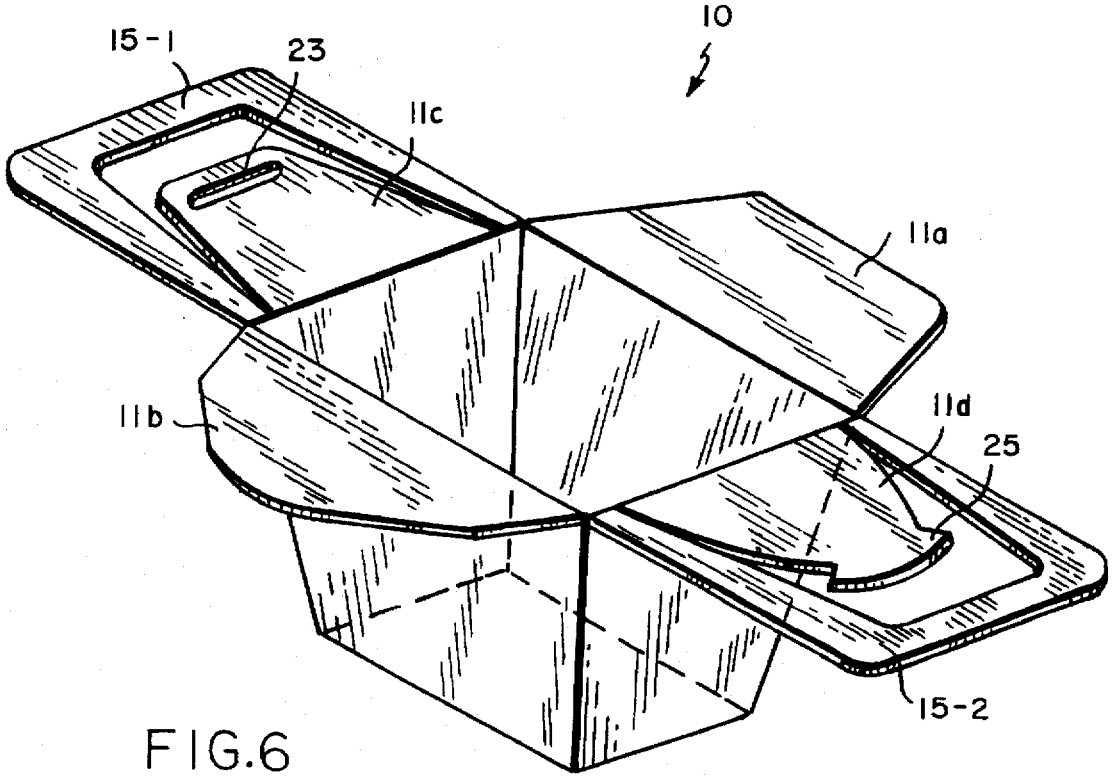
FIG. 6 is a perspective view of a second embodiment of the single piece container of the present invention.

As shown in FIG. 6, a second embodiment of the single piece container 10 is presented. In the second embodiment, the opposing covering flaps 11*a* and 11*b* do not include the slot 23 and the tab 25, respectively. In the second embodiment, the slot 23 is disposed in covering flap 11*c* and the tab 25 is provided on the covering flap 11*d*. In other words, the slot 23 and tab 25 combination are provided on the covering flaps 11*c*, 11*d* which are co-hinged with the handles 15-1, 15-2, respectively. In the second embodiment, covering flaps 11*a* and 11*b* would be closed first followed by flap 11*c* and finally flap 11*d* with the tab 25 fitting into the slot 23.

Figure 7:
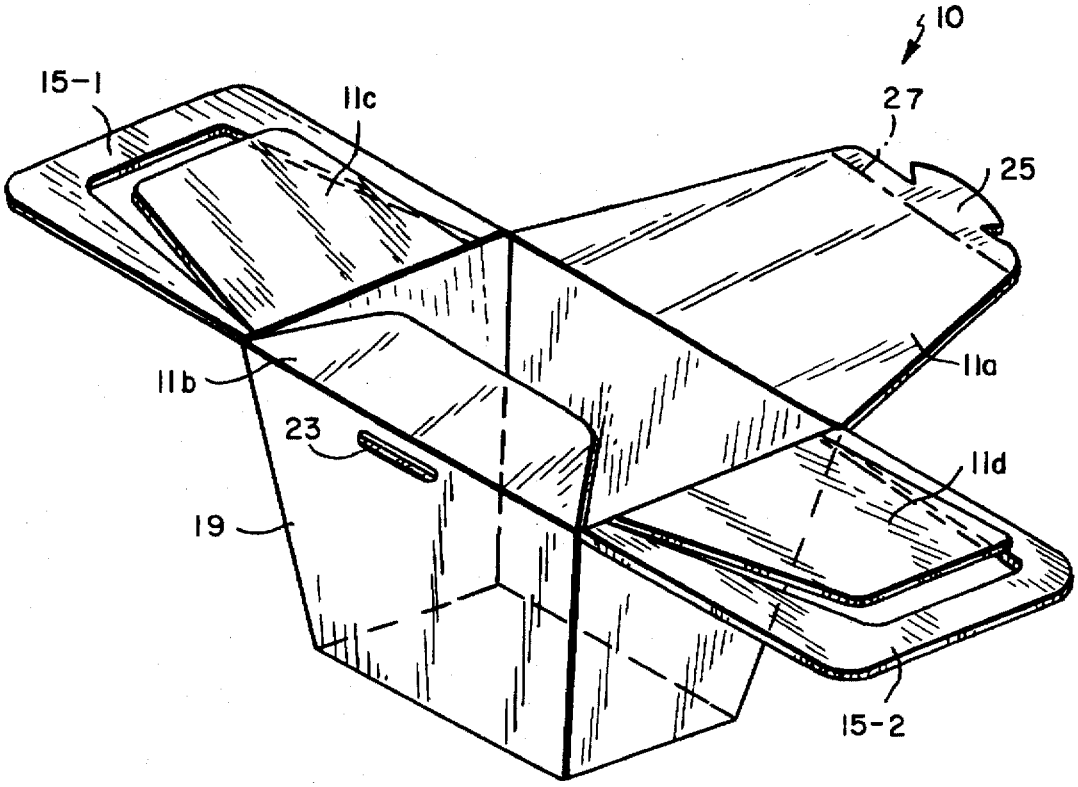
FIG. 7 is a perspective view of a third embodiment of the single piece container of the present invention.

In a third embodiment, the slot 23 is disposed in the sidewall 19 while the tab 25 is disposed on one of the covering flaps 11*a*–11*d*. As shown in FIG. 7, the opposing covering flaps 11*a*–11*d* are provided. In the third embodiment, the covering flap 11*b* is a little shorter than the remaining covering flaps. In addition, as shown, covering flap 11*a* is a little longer than the other covering flaps. In operation, covering flaps 11*c* and 11*d* would be folded over the opening of the container followed by covering flap 11*b*. Lastly, covering flap 11*a* would be folded over the other flaps and the tab 25 would be fitted into the slot 23. Covering flap 11*a* also includes a preformed bend 27 which, when flap 11*a* is closed across the opening, will align with edge 11*b*. As can be seen, any of the covering flaps 11*a*–11*d* can be made of additional length and provided with the tab 25. Provided the slot 23 is disposed in the sidewall opposite the flap with the tab 25, the container will be closable.

Figure 8:
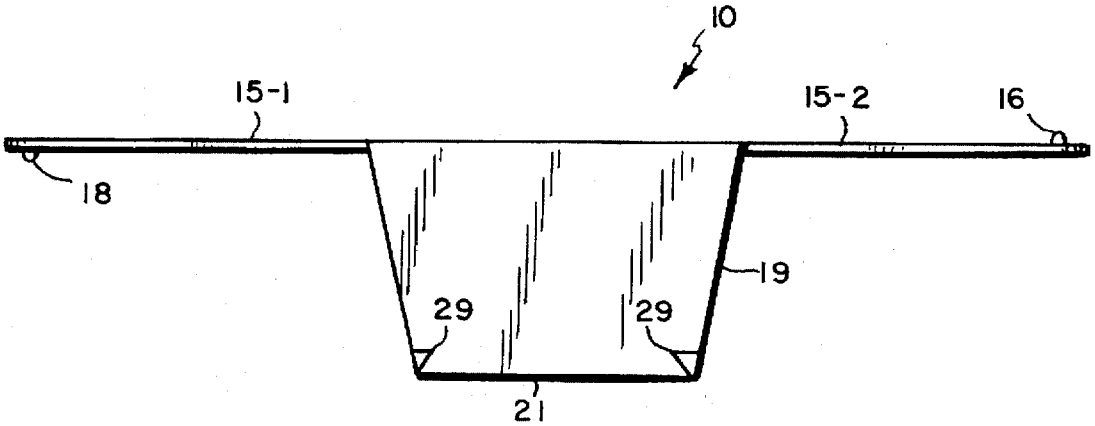
FIG. 8 is a side view of the container body of the single piece container of the present invention.

Each of the foregoing embodiments can include a stacking lug 29 in order to make the stacking and separation of multiple single piece containers possible. As shown in FIG. 8, the stacking lug 29 is located adjacent the sidewall 19 and the bottom 21. The stacking lug 29 extends from the sidewall 19 so as to prevent a bottom 21 of a single piece container 10 within another single piece container 10 from reaching the bottom of the outer single piece container. The stacking lug 29 has a portion which extends out into the container body opening. The shape of the stacking lug 29 is such that it will not make the removal of the single piece container from either a thermal processing die or an injection molding die difficult.

One of ordinary skill in the art can see that the single piece container can be made from many different types of plastics as well as either by thermal forming or injection molding. The single piece container can be made from a material that is either transparent or can have a design placed on the material. In addition, any part of the single piece container can be embossed with different designs or ornamentations.

While preferred embodiments of the invention have been described with a certain degree of particularity with reference to the drawings, obvious modifications and variations are possible in light of the above teachings. It is therefore to be understood that within the scope of the appended claims, the invention may be practiced other than thus specifically described.

What is claimed is:

1. A container comprising an integral formed container body made from a single piece of material having a bottom, a sidewall, and a first pair and a second pair of opposing edges defining a container body opening, a first pair of opposing covering flaps are hingeably disposed at respective opposing edges of the first pair of opposing edges, a second pair of opposing covering flaps are hingeably disposed at a respective opposing edge of the second pair of opposing edges, and a pair of opposing handles are hingeably disposed at respective opposing edges of the second pair of opposing edges;

wherein the pair of opposing handles includes a handle coupling means for releasably coupling the pair of opposing handles by inserting a first portion of the first opposing handle into a second portion of the second opposing handle; and wherein the second portion is surrounded by the second opposing handle.

2. The container as recited in claim 1 wherein the first pair of opposing covering flaps includes a coupling means for releasably coupling the first pair of opposing covering flaps.

3. The container as recited in claim 1 wherein the second pair of opposing covering flaps includes a coupling means for releasably coupling the second pair of opposing covering flaps.

4. The container as recited in claim 2 wherein the coupling means comprise:

a slot on the first opposing covering flap; and a tab on the second opposing covering flap of the first pair.

5. The container as recited in claim 3 wherein the coupling means comprise:

a slot on the first opposing covering flap; and a tab on the second opposing covering flap of the second pair.

6. The container as recited in claim 1 wherein the handle coupling means comprises:

a handle tab disposed on the first opposing handle; and a handle slot disposed on the second opposing handle.

7. The container as recited in claim 1 wherein the handle coupling means comprise:

a locking snap disposed on the first opposing handle; and a locking receiver disposed on the second opposing handle.

8. The container as recited in claim 1 further comprising:

a stacking lug at the bottom of the container body.

9. The container as recited in claim 1 wherein the formed container body is formed by a thermal forming process.

10. The container as recited in claim 1 wherein the formed container body is formed by an injection molding process.

11. The container as recited in claim 1 wherein the single piece of material is a plastic.

12. A container, comprising:

an integral formed container body made from a single piece of material having a bottom, a sidewall, and a first pair and a second pair of opposing edges defining a container body opening, a first pair of opposing covering flaps hingeably disposed at respective opposing edges of the first pair of opposing edges, a second pair of opposing covering flaps hingeably disposed at a respective opposing edge of the second pair of opposing edges, a pair of opposing handles hingeably disposed at respective opposing edges of the second pair of opposing edges, a locking snap disposed on the first opposing handle, and a locking receiver disposed on the second opposing handle.

13. A method of making a container from a single piece of material, the method comprising the steps of:

(a) forming in the single piece of material a container body including a bottom, a first pair of opposing edges and a second pair of opposing edges, the first and second pairs of opposing edges defining a container body opening;

(b) forming a first pair of opposing covering flaps, each flap hingeably disposed at a respective opposing edge in the first pair of opposing edges;

(c) forming a second pair of opposing covering flaps, each flap hingeably disposed at a respective opposing edge in the second pair of opposing edges;

(d) forming a pair of opposing handles, each handle hingeably disposed at a respective opposing edge in the second pair of opposing edges;

(e) forming a first portion in the first opposing handle; and (f) forming a second portion in the second opposing handle, the second portion to receive the first portion and the second portion being surrounded by the second opposing handle.

(f) forming a second portion in the second opposing handle, the second portion to receive the first portion and the second portion being surrounded by the second opposing handle.

14. The method as recited in claim 13 further comprising the steps of:

cutting a slot in the first opposing covering flap in the first pair of covering flaps; and forming a tab in the second opposing covering flap in the first pair of covering flaps, the tab fitting in the slot.

15. The method as recited in claim 13 further comprising the steps of:

cutting a slot in the first opposing covering flaps in the second pair of covering flaps; and forming a tab in the second opposing covering flap in the second pair of covering flaps, the tab fitting in the slot.

16. The method as recited in claim 13 further comprising the step of forming a stacking lug at the bottom of the container body.

17. The method as recited in claim 13 wherein the step of forming the container body comprises a thermal forming process.

18. The method as recited in claim 13 wherein the single piece of material is a plastic.

19. The method as recited in claim 13, wherein:

step (e) includes forming a locking snap in the first opposing handle; and step (f) includes forming a locking receiver in the second opposing handle.

20. The method as recited in claim 13, wherein:

step (e) includes forming a handle tab in the first opposing handle; and step (f) includes forming a handle slot in the second opposing handle.

21. The method as recited in claim 18 wherein the plastic is a recyclable plastic.

22. The method as recited in claim 18 wherein the plastic comprises recycled material.

23. A method of making a container from a single piece of material, the method comprising the steps of:

(a) forming in the single piece of material a container body including a bottom, a first pair of opposing edges and a second pair of opposing edges, the first and second pairs of opposing edges defining a container body opening;

(b) forming a first pair of opposing covering flaps, each flap hingeably disposed at a respective opposing edge in the first pair of opposing edges;

(c) forming a second pair of opposing covering flaps, each flap hingeably disposed at a respective opposing edge in the second pair of opposing edges;

(d) forming a pair of opposing handles, each handle hingeably disposed at a respective opposing edge in the second pair of opposing edges;

(e) forming a locking snap in the first opposing handle; and (f) forming a locking receiver in the second opposing handle.

* * * * *